US005393008A

United States Patent [19]

Kyytsönen et al.

[11] Patent Number: 5,393,008

[45] Date of Patent: * Feb. 28, 1995

[54] REEL-UP WITH SEPARATELY ACTING ACTUATORS FOR INFLUENCING LINEAR PRESSURE

[75] Inventors: Markku Kyytsönen, Numminen, Finland; Tord O. S. Svanqvist, Karlstad, Sweden

[73] Assignee: Valmet-Karlstad, Karlstad, Sweden

[ * ] Notice: The portion of the term of this patent subsequent to Dec. 27, 2011 has been disclaimed.

[21] Appl. No.: 945,850

[22] Filed: Sep. 16, 1992

[30] Foreign Application Priority Data

Sep. 18, 1991 [SE] Sweden ..... 9102705-2

[51] Int. Cl.[6] ..... B65H 18/10; B65H 18/16; B65H 18/26

[52] U.S. Cl. ..... 242/541.1; 242/541.4; 242/542.3; 242/545

[58] Field of Search ..... 242/65, 541.1, 541.4, 242/541.7, 542.3, 545, 546

[56] References Cited

U.S. PATENT DOCUMENTS

| | | | |
|---|---|---|---|
| 2,176,198 | 10/1939 | Berry | 242/65 |
| 2,703,683 | 3/1955 | Evans et al. | 242/65 |
| 3,103,321 | 9/1963 | Jilek | 242/65 |
| 3,116,031 | 12/1963 | Moore et al. | 242/65 |
| 3,202,374 | 8/1965 | Phelps | 242/65 |
| 3,250,483 | 5/1966 | Printz et al. | 242/65 |
| 3,365,141 | 1/1968 | Soloduk | 242/56 R |
| 3,494,566 | 2/1970 | Pawelczyk | 242/56 R |
| 3,666,195 | 5/1972 | Gaudin | 242/75.2 |
| 3,743,199 | 7/1973 | Karr et al. | 242/65 |
| 3,857,524 | 12/1974 | Melead et al. | 242/56 R |
| 3,877,654 | 4/1975 | Randpalu et al. | 242/65 |
| 3,899,892 | 6/1975 | Melead | 242/65 |
| 4,179,330 | 12/1979 | Page | 242/65 |
| 4,711,404 | 12/1987 | Falk | 242/65 |
| 4,744,526 | 5/1988 | Kremar | 242/65 |
| 4,778,122 | 10/1988 | Snygg | 242/65 |
| 4,905,925 | 3/1990 | Kremar | 242/65 |
| 5,069,394 | 12/1991 | Panttila et al. | 242/67.1 R |

FOREIGN PATENT DOCUMENTS

| | | |
|---|---|---|
| 330169 | 2/1989 | European Pat. Off. . |
| 350212 | 1/1990 | European Pat. Off. . |
| 1225014 | 9/1966 | Germany . |
| 3347733 | 3/1990 | Germany . |
| 4478164 | 12/1986 | Sweden . |
| 2900197 | 2/1990 | Sweden . |
| 461976 | 4/1990 | Sweden . |
| WO 90/00511 | 1/1990 | WIPO . |

*Primary Examiner*—Daniel P. Stodola
*Assistant Examiner*—John Q. Nguyen
*Attorney, Agent, or Firm*—Bell, Seltzer, Park & Gibson

[57] ABSTRACT

A reel-up comprises a surface winding drum; two rails to support a reeling drum; and secondary carriages movable linearly along the rails and provided with press devices to press against the reeling drum to maintain a predetermined linear pressure in the nip between the surface winding drum and the paper reel as it increases in size. Each secondary carriage comprises an actuator arranged to press the press device against the reeling drum with a predetermined force to control the linear pressure at each set position of the secondary carriage without influence from the actuator which sets the secondary carriage depending on the growth of the paper reel.

13 Claims, 2 Drawing Sheets

REEL-UP WITH SEPARATELY ACTING ACTUATORS FOR INFLUENCING LINEAR PRESSURE

FIELD AND BACKGROUND OF THE INVENTION

The present invention relates to a reel-up in a paper machine in which paper is manufactured in a continuous web reeled onto reeling drums in the reel-up to produce paper reels, the end portions of each reeling drum being provided with a bearing housing and a braking drum with coupling device.

The commonly used reel-up comprises a stand; a driven surface winding means rotatably journalled in the stand over which surface winding means the web runs; two parallel rails mounted in the stand to support the reeling drum at its bearing housing; and a secondary system movable linearly along the rails and provided in the vicinity of each rail with a linearly movable secondary body, actuators for synchronous movement of the secondary bodies, and press devices disposed on the secondary bodies to press against the bearing housings of the reeling drum in order to maintain a predetermined linear pressure in the nip between the surface winding means and the paper reel as it increases in size.

Secondary systems used hitherto do not provide sufficient accuracy in controlling the linear pressure in the nip between the surface winding drum and the paper reel being growing. One type of secondary system comprises pivotable secondary arms having press devices in the form of rotatably journalled rollers, while another type comprises linearly movable secondary carriages supporting stationary press devices. The linear pressure is controlled by moving the reeling drum in relation to the surface winding drum, this being achieved by a corresponding pivoting of the secondary arms and linear movement of secondary carriages, respectively. In secondary systems comprising secondary arms, friction arises in the hydraulic cylinders turning the secondary arms and also in associated connection joints. Furthermore, the measurement result is affected by the unbalanced mass in the parts causing the friction. The roller of each secondary arm presses against the reeling drum at a contact point which describes a downwardly directed, arc shaped path of movement when the secondary arm is turned in order to adjust the reeling drum as the paper reel increases in diameter. Such variation in vertical direction of the contact point for each roller contributes to the linear pressure being uneven during the winding. The use of the linearly movable secondary carriages eliminates the above-mentioned problems with the exception of the problem of friction.

As the demand for greater accuracy in controlling the linear pressure increases, the demand for paper with uniform properties is also increasing. This latter demand applies particularly to soft paper such as tissue and similar paper for sanitary purposes for which uniform density and permeability from the innermost to the outermost layers of the paper reel is of the utmost importance. An attempt to satisfy the demand for a paper with uniform properties a technique has been developed in which the reeling drum is driven centrally.

According to this technique a drive means comprising a rotatable coupling device is used for coaxial connection to a coupling device in the reeling drum. Central driving enables variation of the linear pressure over a larger interval so that compression of the paper web in the nip between the surface winding drum and the paper reel can be reduced. Combination of a linear secondary system with said central driving eliminates the problem of slipping which may occur between the surface winding drum and paper reel, particularly when the size of the paper reel is increased in diameter. Such larger paper reels cannot be achieved using secondary arms since their range is limited, i.e. the finished paper reel cannot be made larger than is permitted by the range of the arms.

Drum reels-up with secondary arms are described, for instance, in the following patent specifications: EP-0 350 212, US-3 743 199, US-3 857 524, US-3 889 892, US-4 778 122, SE-447 816 and SE-461 976. Drum reels-up with linearly movable secondary bodies are described, for instance, in the following patent specifications: DE-1 225 014, US-3 116 031 and US-3 250 483. The central driving is described, for instance, in the following patent specifications: SE-9000538-0, EP-0 330 169 and US-4 179 330.

However, it has not been possible to utilize the advantages of central driving due to difficulties in aligning and coupling together the central driving and the reeling drum during operation. A contributory cause of these difficulties is that the drive means for the central driving is arranged on a special stand at the one side of the drum reel-up and, when in inoperative position, is entirely separated from the secondary system in order to be moved linearly by its own actuator. As will be understood, the special stand with the central drive means also requires a considerable amount of space.

Furthermore, the reeling drum, central drive means and secondary carriage are locked to each other thereby making it impossible to influence the linear pressure by means of a separate arrangement which is separated from the actuators which set the secondary carriages.

SUMMARY OF THE INVENTION

One object of the present invention is to provide a drum reel-up having a linear secondary system which provides sufficient accuracy for controlling the linear pressure in the nip between the surface winding drum and the paper reel which is growing.

Another object of the invention is to provide a drum reel-up having central driving of the reeling drum and a linear secondary system in which it is possible to control the linear pressure also when the central driving is connected and equally accurately as when the central driving is disconnected.

A further object of the invention is to provide a drum reel-up which includes a linear secondary system and, in combination with or without central driving of the reeling drum, where it is possible to control the linear pressure without affecting the actuators that adjust the secondary carriages as the paper reel increases in diameter.

Yet another object of the invention is to provide a reel-up which includes a linear secondary system and central driving of the reeling drum, which ensures accurate setting of the central drive means and a reeling drum in relation to each other so that their cooperating coupling devices are coaxial before coupling occurs, and where sufficient accuracy for controlling the linear pressure simultaneously is achieved.

The present invention refers to a reel-up in a paper machine in which paper is manufactured in a continuous web reeled onto reeling drums in the reel-up to produce paper reels, the end portions of each reeling drum being provided with a bearing housing and a braking drum with coupling device, said reel-up comprising a stand; a driven surface winding means rotatably journalled in the stand, said web running over said surface winding means; two parallel rails mounted in the stand to support said reeling drum at its bearing housing and a secondary system movable linearly along said rails and provided in the vicinity of each rail with a linearly movable secondary body, actuators for synchronous movement of the secondary bodies, and press devices disposed on the secondary bodies to press against the bearing housing of the reeling drum in order to maintain a predetermined linear pressure in the nip between the surface winding means and the paper reel as it increases in size, each secondary body comprising an actuator arranged to press said press device against the reeling drum with a predetermined force in order to control the linear pressure at each set position of the secondary body without influence from said actuator which sets the secondary body depending on the growth of the paper reel.

When the invention is to be used in a reel-up that also includes a drive means for central driving of the reeling drum, said drive means comprising a rotating coupling device for coaxial connection to one of the coupling devices of the reeling drum during its rotation, the central drive means is mounted on one of the secondary bodies to be moved together with the secondary body, and positioning means are disposed on the secondary bodies to abut in operative position against the bearing housings of the reeling drum on the side facing the surface winding means in order, together with the press devices, to fix the reeling drum so that its axis of rotation coincides with the axis of rotation of the coupling device of the central drive means, said central drive means being movable in relation to the secondary body in a first direction parallel to the reeling drum in order, when said two axes of rotation coincide during operation, with the aid of an actuator, to bring the coupling device of the central drive means into engagement with the opposite coupling device of the reeling drum, and also in a second direction perpendicular to said first direction in order, when the central drive means is connected during operation, to still permit said actuator to be active for control of the linear pressure.

The invention is described hereinafter in more detail with reference to the accompanying drawings.

DESCRIPTION OF PREFERRED EMBODIMENTS

Figure 1:
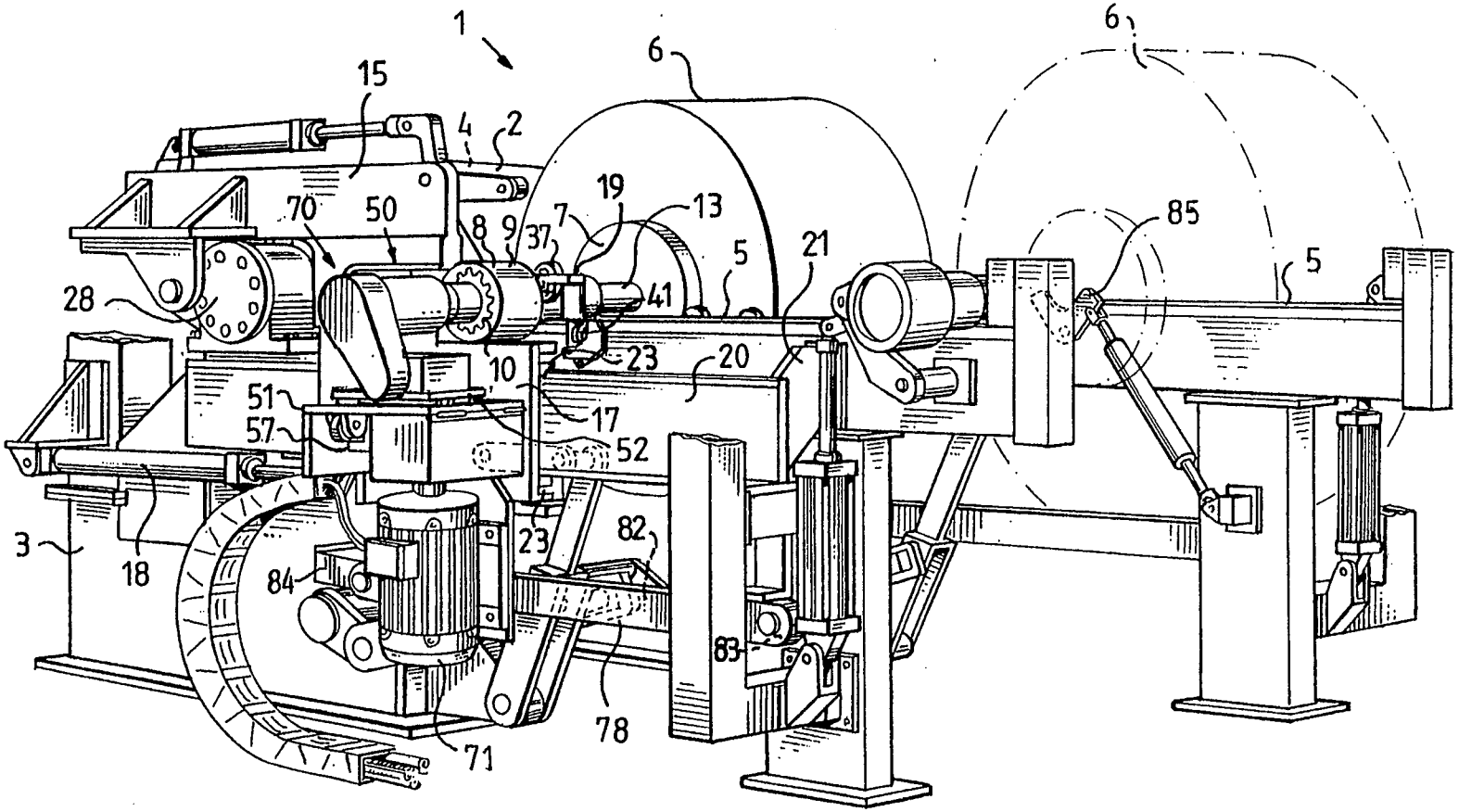
FIG. 1 is a perspective view of parts of a drum reel-up according to the invention.

FIG. 1 shows schematically and in perspective parts of a drum reel-up 1 in a paper machine in which paper is manufactured in a continuous web 2. The drum reel-up has a stand 3 and a surface winding drum 4 rotatably journalled on the stand, said surface winding drum being driven by a motor 28 so that the surface winding drum acquires a peripheral velocity corresponding to the speed at which the paper web 2 is fed forwards. The drum reel-up also includes two horizontal rails 5, disposed parallel to each other and rigidly mounted to the stand 3 at a distance from each other slightly exceeding the width of the paper web 2.

Figure 3:
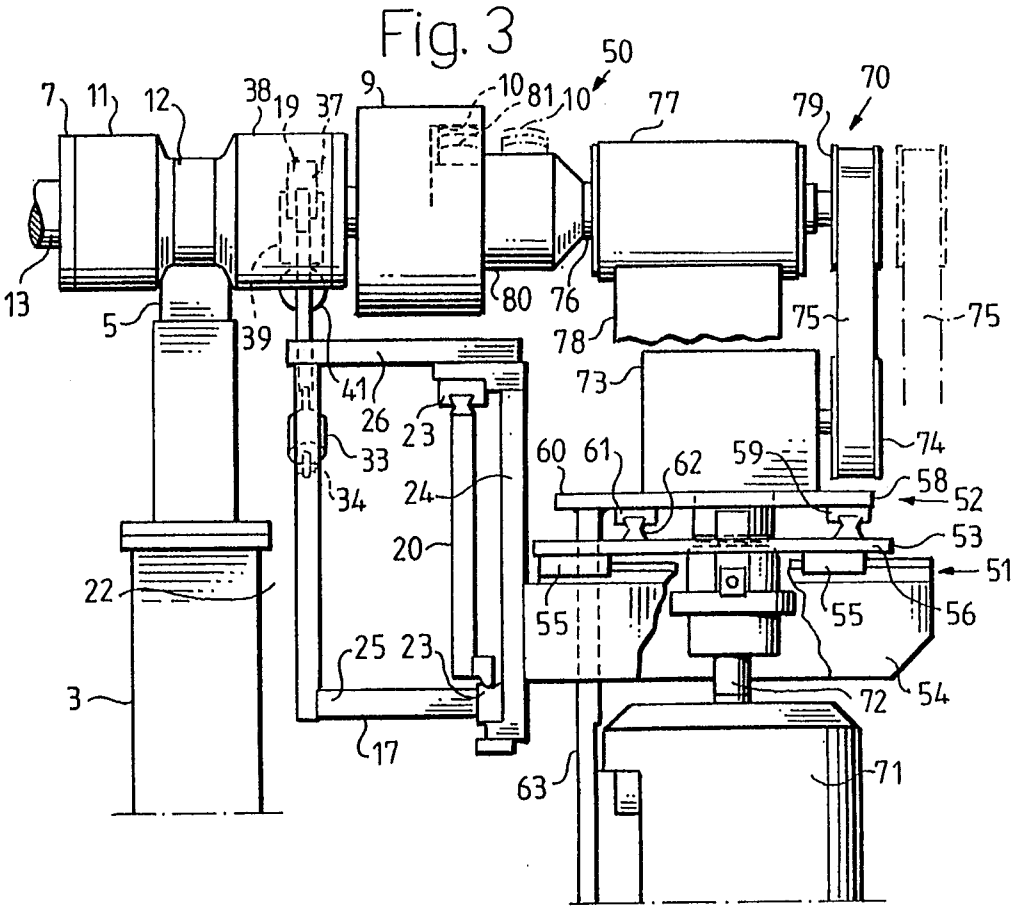
FIG. 3 is a view of the secondary system and a central drive means seen across the stand.

Paper reels 6 are formed in the drum reel-up 1 about a core in the form on a reeling drum 7 supported by the rails 5. The reeling drum 7 is provided at each end with a braking drum 8 comprising a coupling device 9 with an internal toothed rim 10, and a bearing housing 11 located axially inside the braking drum 8 and provided with a peripheral circumferential groove 12 (see FIG. 3) for cooperation with the relevant rail 5. The bearing housing 11 enables the shaft 13 of the reeling drum, and the two coupling devices 9 located at the ends thereof to rotate as a unit together with the growing paper reel 6 while the bearing housings 11 roll along the rails 5 in the direction from the driving surface winding drum 4.

Above the surface winding drum 4 is a store of empty reeling drums 7 and an arrangement for lowering an empty reeling drum 7 for cooperation with the surface winding drum 4 when a paper reel 6 approaches its full size. Said arrangement comprises lowering arms (not shown) and primary arms 15 which receive the reeling drum 7 from the lowering arms so that the bearing housings 11 of the reeling drum 7 rest on the primary arms 15. The reeling drum 7 is retained by the primary arms 15 in a first position a distance above the surface winding drum 4. A motor driven starting device (not shown) is mounted on one side of the drum reel-up 1 to cause the empty reeling drum 7 to rotate with the same peripheral velocity as the surface winding drum 4 in order to avoid friction when the empty reeling drum 7 is subsequently lowered by said primary arms 15 and, in a second position, brought into contact with and driven by the surface winding drum 4. In this second position of the reeling drum 7 the paper web is transferred in suitable manner by suitable means (not shown) to the empty rotating reeling drum 7. This reeling drum is then lowered by means of said primary arms 15 onto the rails 5 where it is supported by the rails. The primary arms 15 return to their initial position to await the next change of reeling drum 7 when the paper reel 6 has increased sufficiently in diameter so that the primary arms 15 are no longer in contact with the reeling drum 7.

Figure 2:
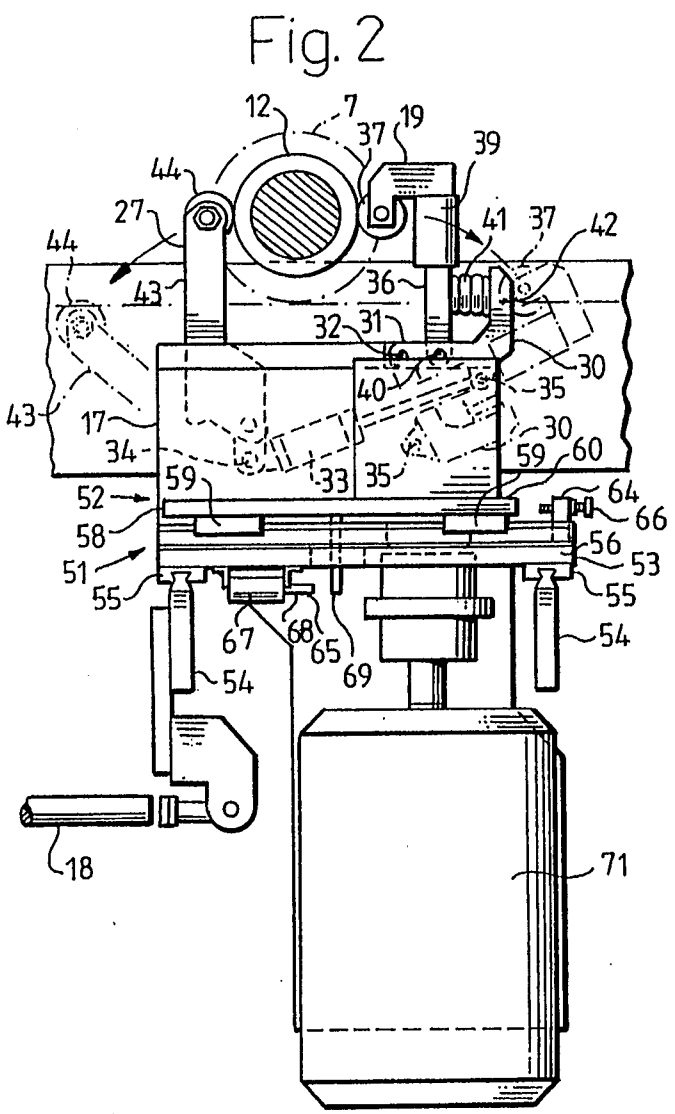
FIG. 2 is a side view of parts of the secondary system of the drum reel-up according to FIG. 1.

The drum reel-up 1 comprises a linearly movable secondary system, arranged near the rails to cooperate with the reeling drum 7 while the paper reel 6 is increasing in size. The secondary system comprises a linearly movable secondary body 17 disposed in the vicinity of each rail 5, two actuators 18 to effect movement of the secondary bodies 17, and two press devices 19 arranged on the secondary bodies 17 to press against the bearing housings 11 of the reeling drum 7 so that a predetermined linear pressure is maintained in the nip between the surface winding drum 4 and the paper reel 6 as it increases in diameter. In the embodiment shown each secondary body 17 consists of a secondary carriage or sledge which is movable along and parallel to the appropriate rail 5. Each secondary carriage 17 is supported by a beam 20 firmly secured by brackets 21 to the outside of the stand 3 in the vicinity of the rail 5 so that a space 22 (see FIG. 3) is formed between the stand 3 and the beam 20. As can be seen more clearly in FIG. 3, the secondary carriage 17 is journalled on the beam 20 by means of linear upper and lower journalling elements 23 comprising roller bearings in order to achieve the least possible friction. The secondary carriage 17 has an outer, vertical side plate 24, a horizontal bottom plate 25 and a horizontal top plate 26. Said actuator 18 of each secondary carriage 17 consists of a cylinder (hydraulic or pneumatic) which is secured by one end to the stand 3 and by the other end to the secondary carriage 17 in order to move the secondary carriage 17 along the beam 20. The movements of the secondary carriages 17 are synchronized with each other. Besides said press devices 19, the linear secondary system also includes two positioning devices 27 (see FIG. 2). The press device 19 and positioning device 27 of each secondary carriage 17 are located in the space 22 between the beam 20 and the stand 3. The press device 19 is supported by an L-shaped connecting piece 30, one leg 31 of which is pivotally connected to the secondary carriage 17 by means of a horizontal bearing pin 32 lying parallel with the central axis of the reeling drum 7. The press device 19 and connecting piece 30 are pivotal together about the bearing pin 32 to be set in a lower, inoperative position in which the press device is not in contact with the reeling drum 7, and an upper, operative position in which it abuts against the reeling drum 7. Pivoting between said two positions is effected with the aid of a hydraulic or pneumatic cylinder 33 secured by one end to the secondary carriage 17 by means of a pin 34 and by the other end to the corner of the L-shaped connecting piece 30 by means of a pin 35. The press device 19 includes an arm 36, the free end of this arm supporting a press roll 37 arranged to cooperate with an outer part 38, in relation to the groove 12, of the bearing housing 11 of the reeling drum 7. The arm 36 is also provided with a load cell 39 on which the press roll 37 is secured. A force exerted on the press roll 37 at its point of pressure against the bearing housing 11 is transmitted to the load cell 39 which is then subjected to a bending moment which is directly proportional to said force. The arm 36 carrying the press roll 37 is pivotally journalled in said leg 31 of the connecting piece 36 by means of a pin 40 lying parallel to the bearing pin 32. The secondary carriage 17 also includes an actuator 41 arranged to press the press device 19 against the reeling drum 7 with a predetermined force in order to control the linear pressure at each set position of the secondary carriage 17 without influence from the actuator 18 which moves the secondary carriage 17 to successively adjust it into new positions as the paper reel increases in diameter. In the embodiment shown the actuator 41 for influencing the press device 19 consists of tubular fluid bellows which can thus expand in longitudinal direction when liquid or gas is pumped in via a pipe (not shown) connected at a suitable point. The bellows 41 which, as opposed to a normal cylinder, gives negligible friction, is located in a space formed between the arm 36 and the other, outwardly directed leg 42 of the L-shaped connecting piece 30 and is secured by its ends to the opposite surfaces of these elements. The L-shaped connecting piece 30 is set by the cylinder 33 in a fixed upper position, in which the press device 19 is simultaneously held in an operative starting position, from whence, influenced by the bellows 41, it is turned about its bearing pin 40 in one direction or the other depending on whether the pressure on the reeling drum is to be increased or decreased.

Said positioning device 27 is turnable between a lower, inoperative position in which it is free from contact with the reeling drum 7, and an upper, fixed, operative position in which it is in contact with the reeling drum 7. The positioning device includes an arm 43 which is pivotally journalled on the secondary carriage 17 by means of a horizontal bearing pin (not shown) lying parallel with the central axis of the reeling drum 7. Pivoting between said two positions is effected with the aid of a hydraulic or pneumatic cylinder (not shown) mounted to the secondary carriage 17. The arm 43 carries a support roll 44 arranged to cooperate with the outer part 38 of the bearing housing 11 of the reeling drum 7. The positioning device 27 is intended to be turned up to its fixed, operative position when a reeling drum 7 is in contact with the press device 19 and when the reeling drum 7 is to be fixed against the press device 19 to define a specific position of the reeling drum in relation to the secondary carriage 17 among other things. The positioning devices 27 are also turned up to fixed, operative position when a full reel of paper 6 is to be moved away from the surface winding drum 4, and thereby function as carriers.

The secondary system is combined with a drive means 50 for central driving of the reeling drum 7. The central drive means 50 is mounted to one of the secondary carriages 17 in order to be moved together with this in a unitary linear movement parallel to the rails 5. The central drive means 50 is also movable in relation to the secondary carriage 17 in a first direction which is perpendicular to this linear movement described by the secondary carriage 17 and central drive means 50 together and thus in a direction parallel to the reeling drum 7, and also in a second direction which is perpendicular to said first direction and thus in the same direction as the direction described by the secondary carriage 17 and central drive means 50 together.

For this purpose the secondary carriage 17 is equipped with a first support and journalling means 51 arranged to support and permit linear movement of the central drive means 50 in relation to the secondary body 17 in said first direction, and also a second support and journalling means 52 arranged to support and permit linear movement of the central drive means 50 in relation to the secondary body 17 in said other direction, said first support and journalling means 51 also carrying the second support and journalling means 52. In the embodiment shown the first support and journalling means 51 includes a sledge 53, two brackets 54 secured to the outer, vertical side plate 24 of the secondary carriage 17 and extending parallel with each other from the outer side thereof, and linear journalling elements 55 including roller bearings to journal the sledge 53 on the brackets. The sledge 53 comprises a horizontal table 56. A pneumatic or hydraulic cylinder 57 (see FIG. 1) is placed below the table 56, between the brackets 54, and is attached by one end to the outer side plate 24 of the secondary carriage 17 and by the other end to the lower side of the table 56. This cylinder 57 enables movement of the table 56, the central drive means 50 and the second support and journalling means 52, in the first direction of movement determined by the journalling elements 55 and brackets 54, this direction being parallel to the reeling drum 7 and perpendicular to the direction of movement of the secondary carriage 17.

In the embodiment shown the second support and journalling means 52 comprise a sledge 58 and linear journalling elements 59, including roller bearings, for journalling the sledge 58 on top of the sledge 53 first described. Said second sledge 58 has a table 60, the journalling elements 59 having upper and lower parts 61, 62 rigidly mounted to the lower side of the second table 60 and the upper side of the first table 56, respectively. A vertical, downwardly directed support element 63 is rigidly connected to the second table 60 and extends through an opening or recess in the first table 56, close to the outer side plate 24 of the secondary carriage 17. The movement of the second sledge 58 along its journalling elements 59 is limited between a first stop element 64 on the upper side of the table 60 and a second stop element 65 on the lower side of the first table 56. The first stop element 64 is provided with a horizontal adjusting screw 66 for adjustment of the stroke length of the sledge in one direction, also defining a fixed, specific position of the sledge 58 and the central drive means in relation to the secondary carriage 17. The second stop element 65 comprises a cylinder 67 mounted on the lower side of the first table 56 and having a horizontally directed piston rod 68 which cooperates with a fixed support 69 mounted on the lower side of the second table 60 and extending through an opening in the first table 56. When the cylinder 67 is inoperative the upper sledge 58 is permitted to move freely in relation to the secondary carriage 17 between the two stop surfaces defined by the ends of the adjusting screw 66 and the piston rod 68. When the cylinder 67 is operative the piston rod 68 is expelled to cooperate with the support 69, thereby moving the upper sledge 58 towards the adjusting screw 66 so that the sledge 58 is fixed in said specific position to enable the central drive means to be brought into engagement with the reeling drum 7.

The central drive means 50 also includes a power transmission means 70 having a motor 71 rigidly mounted to the vertical support element 63 of the upper sledge 58, its drive shaft 72 being vertically directed and extending through openings in the tables 56, 60. The arrangement of the motor 71 described enables the center of gravity of the motor to be located near the beam 20 so that the secondary carriage 17 is subjected to the least possible load torque. The drive shaft 72 of the motor 71 is connected to a mitre-wheel gear 73 disposed on the upper surface of the table 60 and provided with a grooved pulley 74 on its horizontal output shaft, to drive a tooth belt 75. The power transmission means 70 also includes a horizontal shaft 76, rotatably journalled in a bearing housing 77 supported by an upright 78. The upright 78 is rigidly mounted on the upper side of the upper table 60. On the outer end of the shaft 76 is a grooved pulley 79, driven by said tooth belt 75, while on the inner end of the shaft 76 is a coupling device 80 with an external toothed rim 81 and a cylindrical central recess surrounded by the toothed rim 81. To facilitate connection of the two coupling devices 9 and 80 the facing surfaces of the teeth coming into contact with each other are rounded or bevelled. Similarly the free edge of an inner hub of the coupling device 9 is bevelled to facilitate insertion into said central recess of the coupling device 80.

A tooth belt 82 extends horizontally around two rollers 83 journalled in the stand 3 below the secondary carriage 17. One of the rollers 83 is connected to an absolute angle transducer 84. The tooth belt 82 and secondary carriage 17 are connected by means of a rigid connecting element (not shown) so that any linear movement of the secondary carriage 17 in either direction will result in exactly equivalent movement of the tooth belt 82. This movement is sensed by said absolute angle transducer and a signal is generated to indicate the position of the secondary carriage in relation to the surface winding drum 4, said position being a measurement of the size of the paper reel 6.

On the side of each secondary carriage 17 facing away from the surface winding drum 4 is a fork 85 which is turnable to a waiting position when a reeling drum 7 with its paper reel 6 is pushed away from the surface winding drum 4 with the aid of the secondary carriages 17 and their positioning devices 27. The forks 85 are rotated and are locked when the secondary carriages 17 reach their end positions. The central drive means 50 can then be disconnected from the reeling drum 7 which, together with the paper reel 6, is rolled further to an end station with the aid of the fork 85, rotation of the paper reel 6 being retarded by a brake acting on the brake drum 8 of the reeling drum 7.

The load cell 39 of each press device 19 continuously registers the linear pressure and emits a measured value signal to a central unit for comparison with a set value and, in the event of an impermissible difference between these values, the central unit is arranged to emit a signal to activate the actuators 41 for movement of the press devices towards or away from the surface winding means, until the predetermined linear pressure is again registered.

Instead of a surface winding drum to drive the paper reel by means of surface friction, an endless belt may be used, running over two rollers, for instance, one of which is driving.

That which is claimed is:

1. A reel-up in a paper machine in which paper is manufactured in a continuous web and reeled onto reeling drum in the reel-up to produce a paper reel, each end portion of the reeling drum being provided with a bearing housing and a braking drum with a coupling device for optional central driving of said reeling drum, said reel-up comprising a stand; a driven surface winding means rotatably journalled in the stand for advancing the continuous web over said surface winding means in surface-to-surface contact with the paper reel and thereby defining a nip between said surface winding means and the paper reel; two parallel rails mounted in the stand to support the reeling drum at said bearing housings; a secondary system movable linearly along said rails and provided in the vicinity of each rail with a linearly movable secondary body; first actuators mounted on the stand for synchronous movement of the secondary bodies as the diameter of the paper reel increases during Winding; press devices disposed on the secondary bodies; each secondary body comprising a second actuator mounted on a respective press device and arranged to press said press device against a corresponding bearing housing on the reeling drum to control the linear pressure in the nip between the surface winding means and the paper reel independent of said first actuators.

2. A reel-up as recited in claim 1 wherein said second actuators comprise tubular fluid bellows.

3. A reel-up as recited in claim 1 wherein each secondary body consists of a secondary carriage supported by a horizontal beam spaced from said rail and secured to the stand carrying said rail.

4. A reel-up as recited in claim 3 wherein said secondary carriage has an outer side plate and a pair of brackets secured to the outside of the side plate.

5. A reel-up as recited in claim 1 wherein the position of said secondary body in relation to said surface winding means is sensed by an absolute angle transducer.

6. A reel-up as recited in claim 1 wherein each press device comprises a load cell which registers said linear pressure and emits a measured value signal to a central unit for comparison with a set value and, in the event of an impermissible difference between these values, said central unit is arranged to emit a signal to activate said second actuators for movement of said press devices towards or away from the surface winding means until a predetermined linear pressure is again registered.

7. A reel-up in a paper machine in which paper is manufactured in a continuous web and reeled onto a reeling drum in the reel-up to produce a paper reel, each end portion of the reeling drum being provided with a bearing housing and a braking drum with a coupling device for optional central driving of said reeling drum, said reel-up comprising a stand; a driven surface winding means rotatably journalled in the stand for advancing the continuous web over said surface winding means in surface-to-surface contact with the paper reel and thereby defining a nip between said surface winding means and the paper reel; two parallel rails mounted in the stand to support the reeling drum at said bearing housings; a secondary system movable linearly along said rails and provided in the vicinity of each rail with a linearly movable secondary body; first actuators mounted on the stand for synchronous movement of the secondary bodies as the diameter of the paper reel increases during winding; press devices disposed on the secondary bodies; each secondary body comprising a second actuator mounted on a respective press device and arranged to press said press device against a corresponding bearing housing on the reeling drum to control the linear pressure in the nip between the surface winding means and the paper reel independent of from said first actuators; a drive means for central driving of said reeling drum, said central drive means comprising a rotating coupling device for coaxial connection to one of the coupling devices of said reeling drum during its rotation, said central drive means being mounted on one of the secondary bodies to be moved together with said one secondary body; said secondary bodies having positioning means to abut in operative position against the bearing housings of said reeling drum on the side facing the surface winding means in order, together with said press devices, to fix the reeling drum so that its axis of rotation coincides with the axis of rotation of the coupling device of said central drive means; wherein said central drive means is movable in relation to said one secondary body in a first direction parallel to the axis of said reeling drum in order, when said two axes of rotation coincide during operation, with the aid of an actuator, to bring the coupling device of said central drive means into engagement with the opposite coupling device of the reeling drum and also in a second direction perpendicular to said first direction in order, when the central drive means is connected during operation, to still permit said second actuators to control the linear pressure.

8. A reel-up in a paper machine in which paper is manufactured in a continuous web and reeled onto a reeling drum in the reel-up to produce a paper reel, each end portion of the reeling drum being provided with a bearing housing and a braking drum with a coupling device for optional central driving of said reeling drum, said reel-up comprising a stand; a driven surface winding means rotatably journalled in the stand for advancing the continuous web over said surface winding means in surface-to-surface contact with the paper reel and thereby defining a nip between said surface winding means and the paper reel; two parallel rails mounted in the stand to support the reeling drum at said bearing housings; a secondary system movable linearly along said rails and provided in the vicinity of each rail with a linearly movable secondary body; first actuators mounted on the stand for synchronous movement of the secondary bodies as the diameter of the paper reel increases during winding; press devices disposed on the secondary bodies; each secondary body comprising a second actuator mounted on a respective press device and arranged to .press said press device against a corresponding bearing housing on the reeling drum to control the linear pressure in the nip between the surface winding means and the paper reel independent of said first actuators; a drive means for central driving of said reeling drum, said central drive means comprising a rotating coupling device for coaxial connection to one of the coupling devices of said reeling drum during its rotation, said central drive means being mounted on one of the secondary bodies to be moved together with said one secondary body; said secondary bodies having positioning means to abut in operative position against the bearing housings of said reeling drum on the side facing the surface winding means in order, together with said press devices, to fix the reeling drum so that its axis of rotation coincides with the axis of rotation of the coupling device of said central drive means; wherein said central drive means is movable in relation to said one secondary body in a first direction parallel to the axis of said reeling drum in order, when said two axes of rotation coincide during operation, with the aid of an actuator, to bring the coupling device of said central drive means into engagement with the opposite coupling device of the reeling drum and also in a second direction perpendicular to said first direction in order, when the central drive means is connected during operation, to still permit said second actuators to control the linear pressure; and wherein said one secondary body is equipped with a first support and journalling means arranged to support and permit linear movement of said central drive means in relation to said one secondary body in said first direction, and further a second support and journalling means arranged to support and permit linear movement of said central drive means in relation to said one secondary body in said second direction, said first support and journalling means also carrying said second support and journalling means.

9. A reel-up as recited in claim 8 wherein said first support and journalling means comprise a first sledge, brackets rigidly mounted to said secondary body and protruding therefrom, linear journalling elements for journalling said first sledge on said brackets, and an actuator to move the first sledge along the journalling elements together with said central drive means and said second support and journalling means in said first direction, and wherein said second support and journalling means comprises a second sledge and linear journalling elements for journalling the second sledge on top of the first sledge, said second sledge being freely movable in said second direction between two end positions defined by stop elements in order, when said central drive means is connected during operation, to still permit said second actuators to control the linear pressure, said second sledge moving together with said central drive means and the connected reeling drum in said second direction.

10. A reel-up as recited in claim 9 wherein said second sledge is arranged to be fixed in a predetermined position permitting coaxial alignment of said coupling devices with each other when the-central drive means is to be used, while at the same time the positioning devices are in said operative positions.

11. A reel-up as recited in claim 9 wherein said central drive means comprises a power transmission having a motor supported by said second sledge and a horizontal shaft driven by said motor, said horizontal shaft being perpendicular to said rail, extending through a bearing housing and supporting said coupling device.

12. A reel-up as recited in claim 11 wherein said second sledge comprises a horizontal table carrying on its upper surface the bearing housing of said horizontal shaft via an upright and on its lower side carrying said motor via a vertical support element secured to said table.

13. A reel-up as recited in claim 12 wherein the drive shaft of said motor extends vertically up through openings in said first and second sledges and drives said horizontal shaft via a mitre-wheel gear and belt and pulley means.

* * * * *

UNITED STATES PATENT AND TRADEMARK OFFICE

CERTIFICATE OF CORRECTION

PATENT NO. : 5,393,008

DATED : February 28, 1995

INVENTOR(S) : Markku Kyytsönen et al.

It is certified that error appears in the above-identified patent and that said Letters Patent is hereby corrected as shown below:

On the face of the patent under Section 56, References Cited, U.S. Patent No. "3,899,892" should be -- 3,889,892 --.

On the face of the patent under Section 56, References Cited, Swedish Patent "4478164" should be -- 447816 --.

Column 8, line 32, after "onto" an -- a -- should be inserted.

Column 8, line 49, "Winding" should be -- winding --.

Column 8, line 51, "device-" should be -- device --.

Column 9, line 34, "from" should be deleted.

Column 10, line 12, ".press" should be -- press --.

Column 11, line 4, "the-central" should be -- the central --.

Signed and Sealed this

Second Day of May, 1995

Bruce Lehman

*Attest:*

BRUCE LEHMAN

*Attesting Officer*

*Commissioner of Patents and Trademarks*